United States Patent [19]

Caputi

[11] 4,049,306

[45] Sept. 20, 1977

[54] HOLDER FOR SHOE POLISH CONTAINERS

[76] Inventor: Alfred A. Caputi, 61 Sterling Ave., Buffalo, N.Y. 14206

[21] Appl. No.: 684,764

[22] Filed: May 10, 1976

[51] Int. Cl.[2] ..... A47L 23/28

[52] U.S. Cl. ..... 294/34; 15/259

[58] Field of Search ..... 294/1 R, 27 R, 32, 34, 294/103 R, 16; 15/259; 16/110 R, 114 R; 24/255 AS, 255 DH, 263 PJ, 263 SB; 81/3.32, 3.39; 220/8, 96, 85 H, 85 E; 224/45 R, 45 C, 50; 248/310, 311, 313, 316 A

[56] References Cited

U.S. PATENT DOCUMENTS

| | | | |
|---|---|---|---|
| 283,256 | 8/1883 | Lacey | 15/259 |
| 384,338 | 6/1888 | Taylor | 15/259 |
| 466,895 | 1/1892 | Perkins | 15/259 |
| 1,167,102 | 1/1916 | Nelson | 15/259 |
| 2,010,317 | 8/1935 | Olson | 224/45 C UX |
| 2,066,851 | 1/1937 | Noyes et al. | 24/263 SB X |
| 2,566,656 | 9/1951 | David | 248/310 X |
| 3,400,843 | 9/1968 | Johnson | 294/34 X |

*Primary Examiner*—Johnny D. Cherry
*Attorney, Agent, or Firm*—Christel & Bean

[57] ABSTRACT

A holder for shoe polish containers having a circular recess at the upper side of the holder for receiving a conventional relatively flat, circular shoe polish container. A portion of the holder is relatively movable to clamp the container in the holder and the holder has a handle formation at its lower side for manually holding the device during insertion of a container, during removal of the cover or lid thereof, and while the container is in use and until it is again closed by applying the cover or lid thereto.

2 Claims, 5 Drawing Figures

HOLDER FOR SHOE POLISH CONTAINERS

BACKGROUND OF THE INVENTION

This invention relates to holders for shoe polish containers.

The handling of shoe polish of the usual type consisting of a relatively flat circular metal container is awkward and when the container is open and in use the user will generally be unable to avoid soiling his hands with polish, particularly the hand holding the polish container.

SUMMARY OF THE INVENTION

The present invention provides a convenient and effective holder for shoe polish containers of the foregoing type. The holder disclosed herein is designed so that a shoe polish container may be inserted therein while still covered and means are provided so that the container lid may readily be removed from the container while the latter is securely positioned in the holder.

The present holder provides clamp means for holding the container and a handle formation at the bottom of the holder for holding the same during opening thereof and while the container is in use and also when the cover or lid is reapplied to the container after the same has been used.

DESCRIPTION OF THE ILLUSTRATED EMBODIMENT

Figure 1:
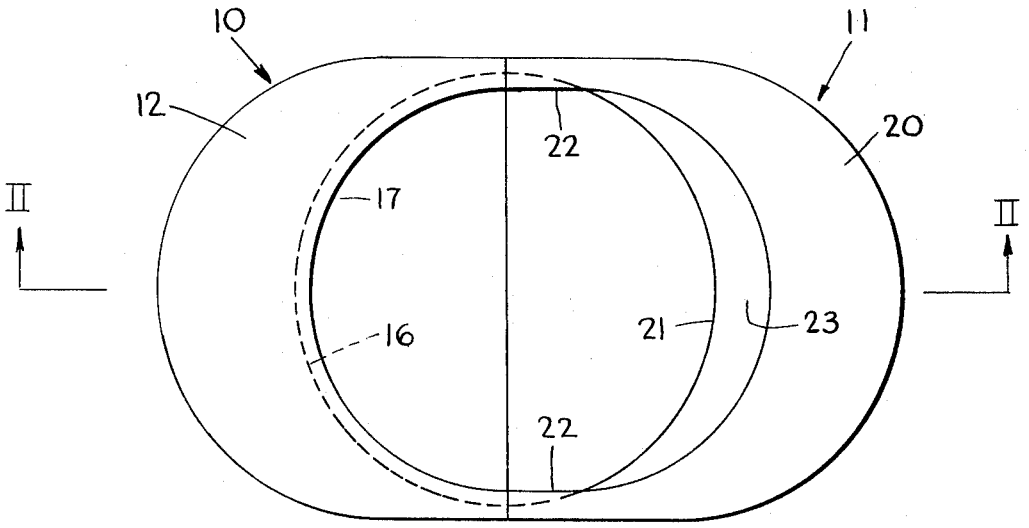
FIG. 1 is a top plan view of one form of the container holder of the present invention.

The shoe polish container holder of the present invention comprises principally a holder member designated generally by the numeral 10 and a releasable clamp element designated generally by the numeral 11. The holder portion 10 includes a top plate portion 12, a bottom longitudinally extending bar portion 13, and a slightly reduced neck portion 14 which connects between plate portion 12 and bar portion 13.

The top plate portion 12 of holder 10 is provided with a semi-circular recess 16 for receiving a conventional shoe polish container and a semi-circular flange 17 overlies recess 16 and is adapted to engage over the usual flange of a shoe polish container.

The clamp member 11 likewise comprises a top plate portion 20 which is complementary to the plate portion 12 of holder 10 and which includes a generally semi-circular recess 21 which is complementary to the recess 16 of holder 10. The clamp element 11 may include flange formations 22 which form continuations of flange 17 of holder 10. Further, clamp element 11 is provided with a generally arcuate recess 23 which permits a shoe polish container which is held in the present holder to be opened in the conventional manner by pressing downwardly on the cover of the container at a specified edge portion of the cover member.

Figure 2:
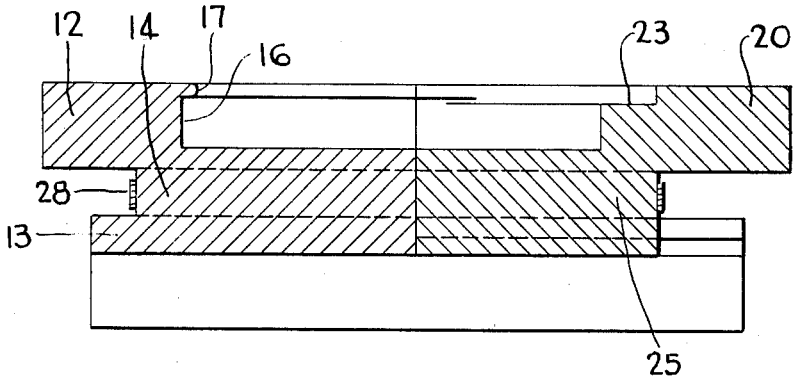
FIG. 2 is a longitudinal cross-sectional view taken on the line II—II of FIG. 1.
Figure 4:
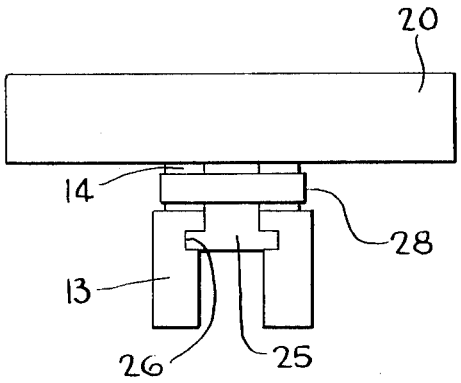
FIG. 4 is an end elevational view taken from the right hand end of FIG. 2.
Figure 5:
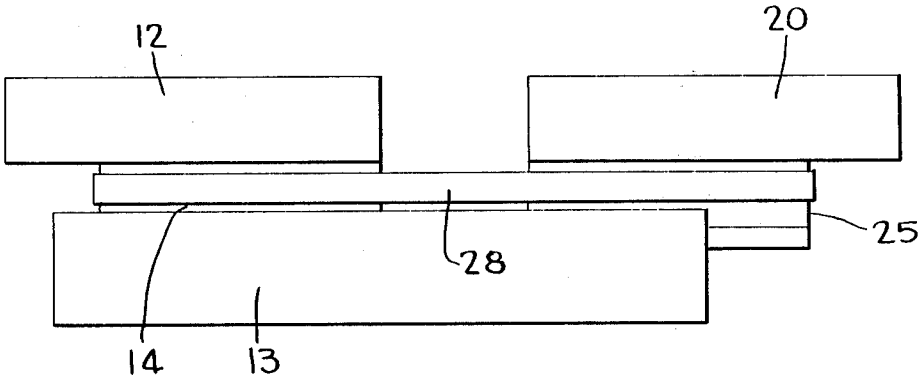
FIG. 5 is an elevational view similar to FIG. 2 but with a clamp portion of the holder shown in a withdrawn position.

As best shown in FIGS. 2, 4 and 5 the underside of plate portion 20 of the clamp element 11 is provided with a rib formation 25 of T cross-section which is slidable in a complementary guide formation 26 in the lower bar formation 13 of holder 10.

Figure 3:
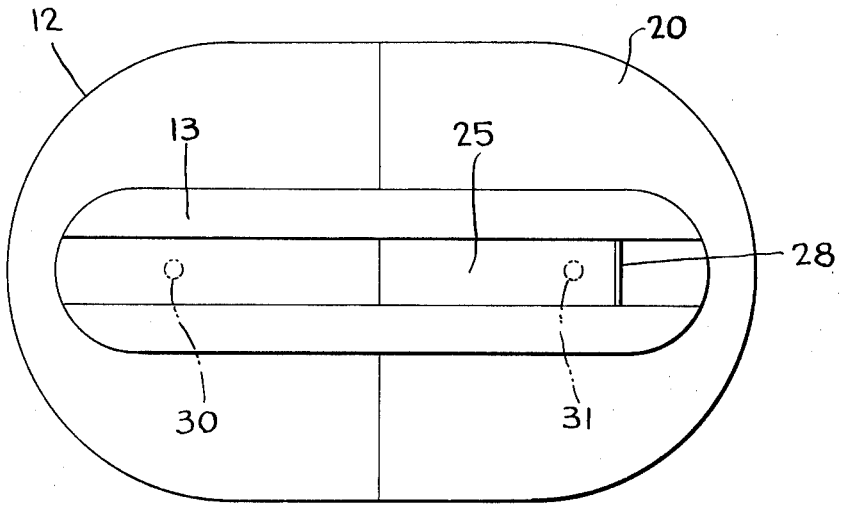
FIG. 3 is a bottom plan view of the structure of FIGS. 1 and 2.

Means are provided for resiliently biasing the clamp element 11 to the closed or clamping position illustrated in FIGS. 1, 2 and 3 and in the principal embodiment this is accomplished by an elastic band 28 which extends about the reduced neck portion 14 of holder 10 and is engaged at its right-hand end as viewed in FIGS. 1 through 3 by the right-hand end of the T formation 25 of clamp element 11. Thus the clamp element 11 may be withdrawn as shown in FIG. 5 against the resistance of the elastic band 28. Other means may be employed for biasing the clamp element to closed position. For instance, as shown in dot and dash lines in FIG. 3, a pair of pins 30 and 31 in bar formation 13 and T formation 25 may be engaged by ends of an extension coil spring (not shown).

A shoe polish container is conveniently inserted in the holder by placing the container against the wall of the arcuate recess 21 of clamp element 11 and pushing to the right to move the clamp element 11 to a slightly opened position until the left-hand end of the container drops into the recess in holder 10. When the container is released the clamp element 11 will move the container to the left until it engages beneath the flange 17 of holder 10.

Various retaining formations other than flange 17 may be provided to adapt the present holder to containers of different design and shape. In one modification the recesses 16 and 21 may be less than semi-circular in extent so that they are free to close upon containers varying slightly in outside diameter.

A preferred embodiment of this invention having been hereinabove described and illustrated in the drawings, it is to be understood that numerous modifications thereof can be made without departing from the broad spirit and scope of this invention as defined in the appended claims.

I claim:

1. In a holder for a circular container for shoe polish or the like having an annular flange thereabout and a circular cover, a body member and a clamp member, said members having co-planar upper surface portions, said clamp member and said body member having cooperating guide formations for movement of said clamp member upper surface portion toward and away from abutment with said body member upper surface portion, said body member having a handle formation at its under side, and resilient means urging said clamp member upper surface portion toward said body member upper surface portion, said upper surface portions having complementary generally semi-circular recesses for jointly receiving and clamping opposite sides of the periphery of a circular container therein.

2. A holder according to claim 1 wherein said handle formation extends longitudinally beneath said clamp member and includes said guide formations for said clamp member.

* * * * *